US005198523A

United States Patent [19]

Baumann et al.

[11] Patent Number: 5,198,523

[45] Date of Patent: Mar. 30, 1993

[54] GLOVE BOX FROM POLYURETHANE

[75] Inventors: Siegfried Baumann, Karlstein; Wolfgang Dams, Zwingenberg; Werner Wegner, Hofheim-Marxheim, all of Fed. Rep. of Germany

[73] Assignee: Siemens Aktiengesellschaft, Munich, Fed. Rep. of Germany

[21] Appl. No.: 847,794

[22] Filed: Mar. 6, 1992

Related U.S. Application Data

[63] Continuation-in-part of Ser. No. 758,352, Sep. 9, 1991, abandoned, which is a continuation of Ser. No. 222,269, Jul. 21, 1988, abandoned.

[30] Foreign Application Priority Data

Jul. 22, 1987 [DE] Fed. Rep. of Germany ... 8710058[U]

[51] Int. Cl.[5] ..... C08G 18/06

[52] U.S. Cl. ..... 528/85; 528/906; 312/1; 52/398; 49/488

[58] Field of Search ..... 528/85, 906; 312/1; 52/398; 49/488

[56] References Cited

U.S. PATENT DOCUMENTS 4,141,609 2/1979 Eisert ..... 312/1

*Primary Examiner*—Maurice J. Welsh

*Attorney, Agent, or Firm*—Herbert L. Lerner; Laurence A. Greenberg

[57] ABSTRACT

A glove box includes a housing having an opening formed therein. A bag is disposed on the housing covering the opening. The bag is single-layered and formed of a weldable thermoplastic polyurethane with physically reversibly cross-linked fusible molecules.

8 Claims, 1 Drawing Sheet

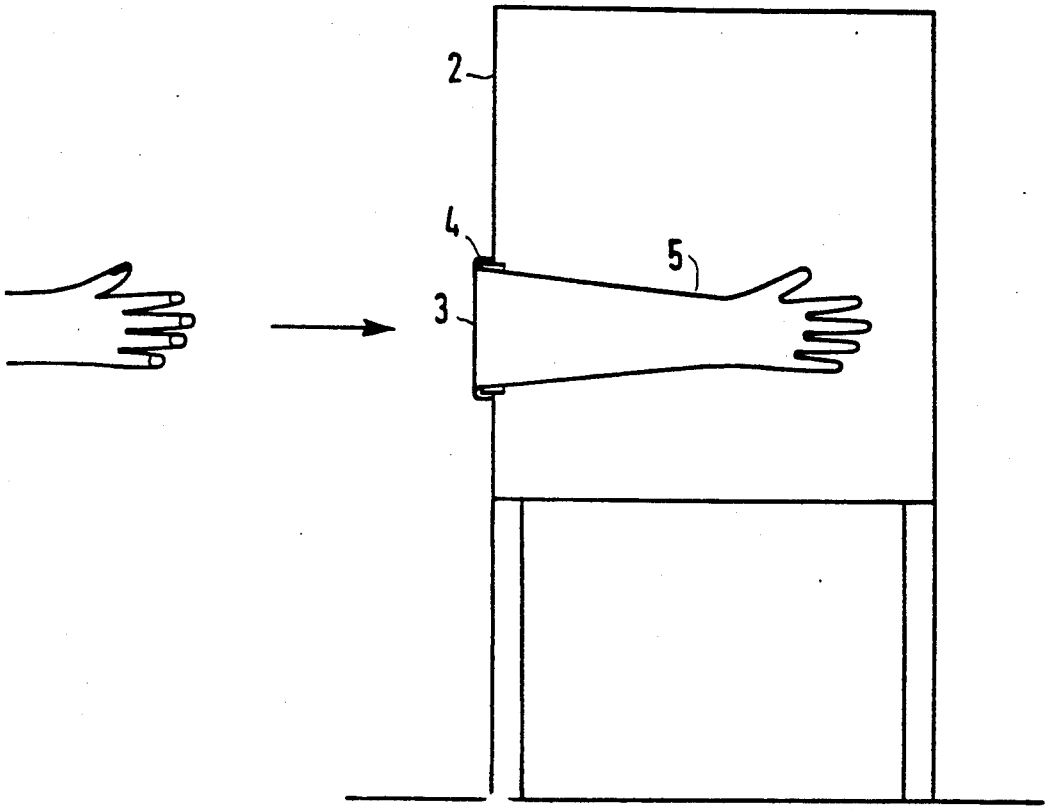
2
4
5
3

GLOVE BOX FROM POLYURETHANE

CROSS-REFERENCE TO RELATED APPLICATION

This application is a continuation-in-part of application Ser. No. 758,352, filed Sep. 9, 1991, which was a File Wrapper continuing application of application Ser. No. 222,269, filed Jul. 21, 1988 both now abandoned.

BACKGROUND OF THE INVENTION

1. Field of the Invention

The invention relates to a glove box, having a housing opening at which a bag, in particular a gas-tight glove, a gas-tight outward transfer bag or a gas-tight connection bag for connection to a container, is disposed.

2. Description of the Related Art

A glove box of this type is known from German Published, Non-Prosecuted Application DE-OS 32 01 976. The gas-tight bag in that known glove box is a glove having a matrix that has a surface coating of halogen-free elastomer and/or polyolefin on the active inner surface of the glove. The polyolefin may be polyethylene, while a surface coating of chlorosulfonated polyethylene may be disposed on the matrix on the inactive outer surface of the glove.

If work is done with radioactive emitters in the prior art glove box, in particular alpha emitters such as plutonium, then the surface coating of halogen-free elastomer and/or polyolefin on the active inner surface of the glove prevents halogens, in particular chlorine, from being liberated by the radioactive radiation on the active inner surface of the glove and from reaching the glove box and thus the radioactive emitter.

Keeping the radioactive emitter free of halogen contamination avoids corrosion of metal enclosures into which the radioactive emitter is introduced, which is caused by halogens emitted by the radioactive emitter. This is particularly important where the radioactive emitter is in the form of pellets of plutonium or mixed plutonium oxide, which are used as nuclear fuel in existing cladding tubes, for example those made of a zirconium alloy, in fuel rods of a nuclear reactor fuel assembly. During use in a nuclear reactor, greater corrosion damage must be expected in these cladding tubes, if the nuclear fuel emits halogens.

Although glove boxes having single-layer gas-tight bags disposed at housing openings are already known, these known gas-tight bags are formed of polyvinyl chloride. This means that they emit undesirable chlorine to radioactive emitters in the glove boxes. British Patent No. 2,148,094 also discloses a multi-layer polyurethane-rubber glove with a woven reinforcing fabric, which is used for work in the kitchen or in the medical field.

From U.S. Pat. No. 4,141,609 to Eisert there is known a glove box with a glove, the arm of which is formed of a sprayed polyurethane elastomer. Such sprayable polyurethane elastomers belongs to the group of casting elastomers and it has chemically cross-linked, i.e. irreversibly cross-linked, molecules. The material is neither thermoplastic nor can it be melted down, i.e. it cannot be welded.

It is accordingly an object of the invention to provide a glove box, which overcomes the hereinafore-mentioned disadvantages of the heretofore-known devices of this general type and which refines the prior art glove box by providing a gas-tight bag of single-layer material.

SUMMARY OF THE INVENTION

With the foregoing and other objects in view there is provided, in accordance with the invention, a glove box, comprising a housing having an opening formed therein, and a bag disposed on the housing covering the opening, the bag being formed of single-layered, weldable thermoplastic polyurethane with physically reversibly cross-linked fusible molecules. The bag may be a gas-tight glove, a gas-tight outward transfer bag, or a gas-tight connection bag for connection to a container.

The thermoplastic polyurethane used for the bag of the glove box is a thermoplastic polyurethane elastomer. It does not contain any halogen and consequently cannot contaminate radioactive emitters processed in the glove box with halogen. In the case of an outward transfer bag that must later be combusted in the course of waste disposal, corrosion of the combustion furnace is also avoided, because of the absence of halogen. Furthermore, the bag of the thermoplastic polyurethane elastomer is distinguished by great elasticity and high resiliency, so that a very tight fit on a connector stub located at the housing opening of the glove box can be attained with the bag. The bag of the thermoplastic polyurethane elastomer also has great resistance to tearing, great elongation when tearing, and great puncture resistance, so that it can only be damaged with difficulty, if at all, by mechanical implements, such as pointed objects. Finally, the bag of the thermoplastic polyurethane elastomer can be readily welded with highfrequency welding apparatus, it is resistant to abrasion, it is s ideable and it does not stick.

In accordance with an added feature of the invention, the thermoplastic polyurethane has the following basic structure:

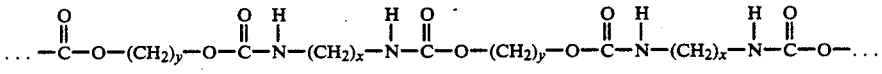

where x and y are integers.

In accordance with a concomitant feature of the invention, the thermoplastic polyurethane has the following basic structure:

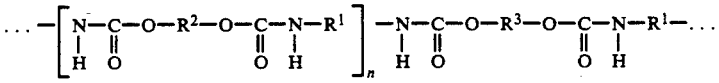

where n = 1,2,3 . . ., $R^1$ is an isocyanate radical, $R^2$ is a chain extender radical, and $R^3$ is a radical of diol of molar mass 1000 to 3000, and preferably of 2000.

Other features which are considered as characteristic for the invention are set forth in the appended claims.

Although the invention is illustrated and described herein as embodied in a glove box, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the drawing.

BRIEF DESCRIPTION OF THE DRAWING

The drawing is a fragmentary, side-elevational view of a hand approaching a glove box according to the invention.

DESCRIPTION OF THE PREFERRED EMBODIMENT

Referring now to the single FIGURE of the drawing in detail, there is seen a glove box having a wall 2, in which a housing opening 3 is formed. A ring 4 which protrudes toward the outside is inserted in the housing opening 3. As shown in the drawing, a bag 5 is seated on the ring on the outside of the housing wall 2. The bag 5 may be a gas-tight work glove, a gas-tight outward transfer bag, or a gas-tight connecting bag having two open ends, intended for connection with a container, such as a protruding ring in a housing opening of some other glove box. The gas-tight bag 5 is single-layered and is formed of thermoplastic polyurethane, which is reversibly cross-linked, such as by the polyaddition of di or triisocyanates having polyols or polydiols (for example, polyester diols, polyether diols or polycarbonate diols). The thermoplastic polyurethane, as a thermoplastic polyurethane elastomer, has physically reversibly cross-linked, fusible molecules with an amorphous or partially crystalline structure, for example having the following basic structure:

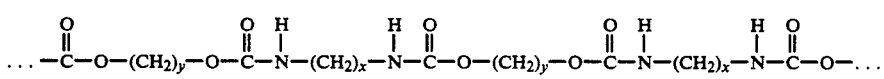

where x and y are integers.

The polyurethane is crystalline and does not stick because of the long cross-linking of its molecules. The relevant material variables thereof depend on x and y, for instance, and are as follows:

Tear resistance (longitudinally and transversely) according to DIN 53 455: 50–75 N/mm$^2$ Elongation to tearing according to DIN 53 455: 500–700%

Further tear resistance according to DIN 53 363: >70 N/mm

Viscoplastic behavior according to DIN 53 373:

Puncture strength: 50–75 N

Puncture distance: 50–75 mm

Puncture work: >150 N cm.

The single-layer gas-tight bag 5 may also be formed of a thermoplastic polyurethane elastomer with physically reversibly cross-linked fusible molecules which is produced by the polyaddition of diisocyanates with a polyol mixture including a long-chained diol of molar mass 1000 to 3000, preferably 2000 (for example: polyester diol, polyether diol, or polycarbonate diol) and a conventional chain extender (for example: butane diol-(1,4) or diethylene glycol) and which has the following basic structure:

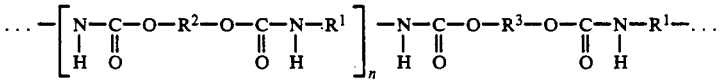

where n = 1,2,3 . . ., $R^1$ is an isocyanate radical, $R^2$ is a chain extender radical, and $R^3$ is a diol of molar mass 1000 to 3000.

We claim:

1. Glove box, comprising a housing having an opening formed therein, and a bag disposed on said housing covering said opening, said bag being single-layered and formed of weldable thermoplastic polyurethane with physically reversibly cross-linked fusible molecules.

2. Glove box according to claim 1, wherein said thermoplastic polyurethane is weldable at high frequency.

3. Glove box according to claim 1, wherein said bag is a gas-tight glove.

4. Glove box according to claim 1, wherein said bag is a gas-tight outward transfer bag.

5. Glove box according to claim 1, wherein said bag is a gas-tight connection bag for connection to a container.

6. Glove box according to claim 1, wherein said thermoplastic polyurethane has the following basic structure:

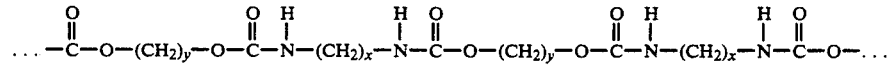

where x and y are integers.

7. Glove box according to claim 1, wherein said thermoplastic polyurethane has the following basic structure:

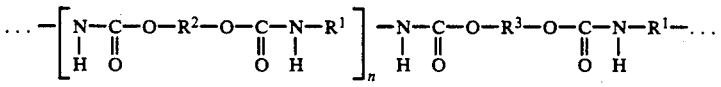

where n is an integer and n ≧1, $R^1$ is an isocyanate radical, $R^2$ is a chain extender radical, and $R^3$ is a radical of diol of molar mass 1000 to 3000.

8. Glove box according to claim 7, wherein said $R^3$ is a radical of diol of molar mass of substantially 2000.

* * * * *